US006375103B1

(12) United States Patent
Huang et al.

(10) Patent No.: US 6,375,103 B1
(45) Date of Patent: Apr. 23, 2002

(54) MILL FOR PULVERIZING AND CLASSIFYING PARTICULATE MATERIAL

(75) Inventors: Ching-Chung Huang, Summit; Robin T. Voorhees, Basking Ridge, both of NJ (US)

(73) Assignee: Hosokawa Micron Powder Systems, Summit, NJ (US)

( * ) Notice: Subject to any disclaimer, the term of this patent is extended or adjusted under 35 U.S.C. 154(b) by 0 days.

(21) Appl. No.: 09/541,165

(22) Filed: Mar. 31, 2000

(51) Int. Cl.[7] ..... B02C 23/32
(52) U.S. Cl. ..... 241/79.1; 241/80
(58) Field of Search ..... 241/80, 97, 79.1, 241/39

(56) References Cited

U.S. PATENT DOCUMENTS 3,741,485 A * 6/1973 Gage et al. ..... 241/39
4,304,360 A * 12/1981 Luhr et al. ..... 241/79.1
4,582,260 A * 4/1986 Folsberg ..... 241/80
5,277,370 A 1/1994 Schatz
5,797,550 A 8/1998 Woodall et al.

OTHER PUBLICATIONS

Hosokawa Micron Powder Systems product brochure for Alpine Powderplex® Classifier Mills APP.

Netzsch–Condux product brochure for Condux Impact Mill CP.

* cited by examiner

*Primary Examiner*—Mark Rosenbaum
(74) *Attorney, Agent, or Firm*—Winston & Strawn

(57) ABSTRACT

A cost efficient single-drive particulate material pulverizing and classifying mill capable of operating at high efficiencies and able to conveniently produce selectively sized particles from a wide variety of materials during milling operation without restructuring the mill configuration.

19 Claims, 1 Drawing Sheet

MILL FOR PULVERIZING AND CLASSIFYING PARTICULATE MATERIAL

TECHNICAL FIELD

This invention relates generally to improvements in mills for pulverizing particulate material and classifying the resulting particles.

BACKGROUND

Pulverizing and classification of dry materials is practiced today using hammer-screen mills, impact attrition mills, ball mills, pin mills and others outfitted with internal classifiers that separate the coarse and the fine particle fractions. The air classifying mill is popular equipment for pulverizing and separating particulate material (e.g., chemicals, minerals, fertilizers, foodstuffs, and powder coatings) into selectively sized particles. In general, air classifying mills can be classified into two types; single- and dual-drive.

Dual-drive mills can pulverize a wide variety of materials and allow the operator to control the particle size simply by drive speed adjustment. Typically, dual-drive air classifying mills comprise a housing containing a pulverizing disk and a particle classifier, wherein each of the pulverizing disk and the classifier are controlled by a separate drive. One drive adjusts the classifier speed to control the particle size while the second drive controls the pulverizing disk speed, which is adjusted depending on the hardness and toughness of the particulate material. Because the speeds of the classifier and the pulverizing disk are each controlled by a separate drive, they can be adjusted independently. A disadvantages of dual-drive mills is that they are mechanically complicated and thus more expensive and more prone to mechanical failure than mills of simpler construction.

Single-drive mills are of more simple construction, less expensive, and more rugged because both the pulverizing disk and particle classifier are driven by the same drive. As such, the operator has limited control over particle size, and versatility with respect to material hardness is very limited. Consequently, there is less control of particle size and the type of particulate material that can be pulverized is relatively limited.

A need exists for an economically priced and rugged single-drive particulate material pulverizing and classifying mill capable of conveniently producing selectively sized particles from a wide variety of materials.

SUMMARY OF THE INVENTION

The present invention provides a mill that satisfies this need. The invention provides a cost efficient and rugged single-drive air classifying mill of simple design capable of operating at high efficiency and able to produce a wide range of particle sized for a wide range of materials.

In one embodiment, a mill is provided for pulverizing and classifying particulate material comprising: a housing having an air intake, a particulate-material inlet, a particle outlet, and a particulate material pulverizing and classifying assembly for receiving the particulate material from the inlet, pulverizing the particulate material into pulverized particles, and separating the pulverized particles by a size of the pulverized particles. The pulverizing and classifying assembly is rotatably mounted on a drive shaft and positioned within the housing. Advantageously, the mill has a particle-removal conduit connected to the particle outlet and extending into the assembly for removal of the pulverized particles. Preferably, the housing is provided with an inner liner having a selectively shaped pattern to assist in pulverizing the particulate material.

In another embodiment, the mill of the invention has a particulate material pulverizing and classifying assembly comprising a pulverizing disk rotatably supported by the drive shaft, a classifier supported by the pulverizing disk and having first and second ends. The second end is adjacent to the housing while the first end adjacent to the pulverizing disk. A pulverizing domain exists between the pulverizing disk and the housing and the particle-removal conduit extends into the second end of the classifier for separating the pulverized particles according to size.

Also, it is preferred that the extension of the particle-removal conduit is adjustable to control the size of the pulverized particles accepted by the classifier and thereafter directed to the particle outlet for collection.

Preferably, the second end of the classifier fits at least partially within a groove in the housing to prevent the pulverized particles from passing around the second end of the classifier. It is also preferable that the mill further comprise a shroud oriented parallel to the drive shaft and surrounding at least a portion of the assembly to separate the pulverizing domain from the classifying zone and to assist in directing the pulverized particles to the classifier.

In another embodiment, the mill of the invention comprises a classifier wherein the first end has a diameter that is different than that of the second end to create a tangential air velocity differential between the first end and the second end to assist in the separation of the pulverized particles. In one embodiment, the diameter of the first end of the classifier is larger than the diameter of the second end to provide a higher tangential air velocity at the first end. In another embodiment, the diameter of the first end of the classifier is smaller than the diameter of the second end to provide a higher tangential air velocity at the second end. Preferably, the classifier is in the shape of a cone.

BRIEF DESCRIPTION OF THE DRAWINGS

These and other features, aspects, and advantages of the invention will become better understood with reference to the following detailed description, examples, appended claims, and accompanying drawings where;

DETAILED DESCRIPTION OF THE PREFERRED EMBODIMENTS

Figure 1:
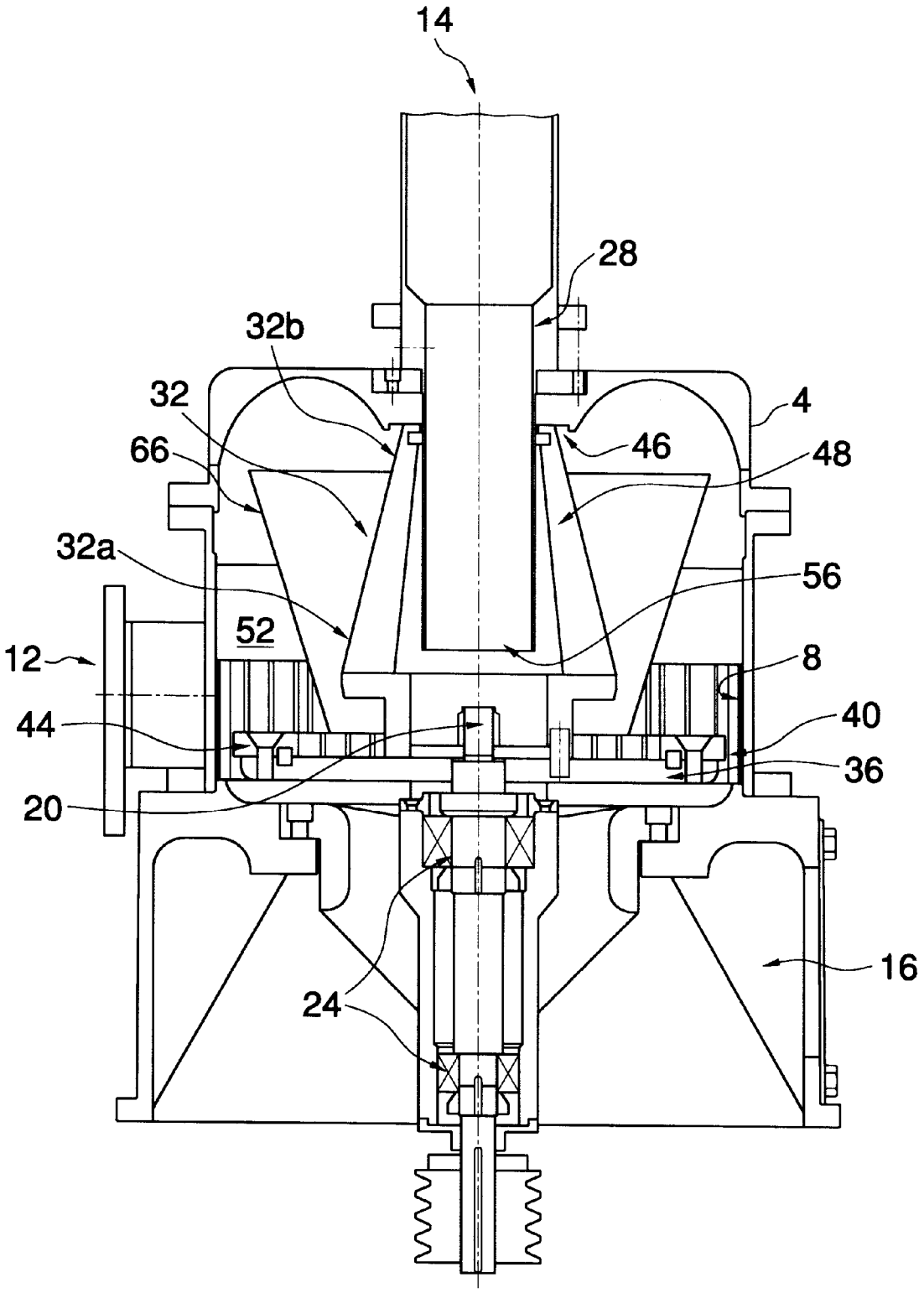
FIG. 1 is a side view, in cross section, of a particulate material pulverizing and classifying mill according to the invention.

One embodiment of the invention comprises a single-drive particulate material pulverizing and classifying mill with a particle-removal conduit adjustably extending into the classifier to control the size of the pulverized particles accepted by the classifier (i.e., allowed to pass through the classifier) and thus directed to the particle outlet. During mill operation, the classifier rotates at the same rpm as the pulverizing rotor. The particle size accepted by the classifier can easily be adjusted by varying the air flow rate, rotor rpm, and the extension of the particle-removal conduit into the classifier. The extension of the particle-removal conduit into the classifier changes the effective cut size of the classification. The particle-removal conduit extension effect in conjunction with classifier design provides a mechanism to continuously adjust the particle fineness without stopping the mill operation, changing the air flow rate, or adjusting the drive shaft rpm. In addition, variation of the particle-removal conduit diameter or the number of blades on the classifier can provide further adjustability to the fineness of grinds. Advantageously, because only a single drive is necessary, the cost is much less and the mill is less complicated than dual-drive pulverizing and classifying assemblies.

The particulate material pulverizing and classifying mill of the invention is understood more fully with reference to FIG. 1. In one embodiment, the particulate material pulverizing and classifying mill of the invention comprises vertically oriented cylindrical hollow housing 4 having inner liner 8. Preferably, liner 8 comprises a selectively shaped pattern, preferably a ridge pattern, to assist in pulverizing the particulate material. Housing 4 is provided with particulate-material inlet 12, particle outlet 14, air intake 16, drive shaft 20, supported by suitable bearing member 24, and particle-removal conduit 28. Drive shaft 20 is oriented along the vertical axis of housing 4. Within housing 4, drive shaft 20 rotatably supports a particulate material pulverizing and classifying assembly comprising pulverizing disk 36 that supports classifier 32. The classifier has first end 32*a* and a second end 32*b*, and is supported such that the first end 32*a* is adjacent to the pulverizing disk 36 and second end 32*b* is adjacent to the upper section of housing 4.

Pulverizing disk 36 is of a diameter such that an effective pulverizing domain 40 exist between inner liner 8 and the periphery of pulverizing disk 36. Preferably, pulverizing disk 36 supports a plurality of beaters 44 the outer edges of which are oriented parallel to drive shaft 20.

In a preferred embodiment, classifier 32 is positioned on drive shaft 20 such that the classifier's second end 32*b* fits at least partially within groove 46 to ensure particle flow through classifier 32 before exiting the mill through particle-removal conduit 28. Preferably, classifier 32 comprises a plurality of angularly disposed and selectively spaced vane members 48. The dimensions and shape of classifier 32 and vane members 48 are variable and one of skill in the art can readily make adjustments depending on the desired fineness of the ground product. Advantageously, because particle-removal conduit 28's extension into classifier 32 is adjustable, the fineness of ground product can be varied during milling operation with a relatively inexpensive classifier. For example, a 6-vane classifier, when used for classification in the present single-drive mill, gives comparable fineness of ground product to that of a 24-vane classifier used in a conventional dual-drive mill. The most preferred classifier shape is a cone shape. In the preferred classifier design, the diameter of the first end is different than that of the second end. In one embodiment, when a fine grind of particles is desired, it is preferable that the diameter of the second end 32*b* is smaller than the diameter of the first end 32*a*. In an alternative embodiment, when a coarse grind of particles is desired, it is more preferable that the diameter of the second end 32*b* is larger than the diameter of the first end 32*a*.

Particle-removal conduit 28 is oriented along the vertical axis of housing 4 and extends through particle outlet 14 and into housing 4 into the classifier's second end 32*b*. Particle-removal conduit 28 can be of any dimensions and one of skill in the art can readily determine the conduit dimensions for the particular application. The particle outlet 14 is provided with a suction source (not shown).

The extension of particle-removal conduit 28 into classifier 32 can be adjusted. As will be explained more fully, this extension determines the fineness of the particles accepted by the classifier. As used herein "extension" means the length of the portion of particle-removal conduit 28 located within classifier 32.

In a preferred embodiment, the mill of the invention includes stationary shroud 66, preferably in the form of a hollow cone that surrounds at least part of classifier 32. Shroud 66 may be supported by a plurality of baffles 52 that are secured to inner liner 8 of housing 4.

In operation, particle-removal conduit 28 is connected to particle outlet 14, which, in turn, is connected to a suction source (not shown) to draw air though classifier 32. Drive shaft 20 is rotated at high speed by a motor of any suitable construction, preferably, a variable speed motor. The material to be ground is fed at a preselected rate into housing 4 through particulate-material inlet 12 to be ground in pulverizing domain 40 by the action of the rapidly rotating pulverizing disk 36 and stationary inner liner 8. Particulate-material inlet 12 can be at any location on housing 4. Preferably, for hard-to-grind material, particulate-material inlet 12 is positioned at a point adjacent to the periphery of the pulverizing disk 36. The fan action generated by pulverizing disk 36 effects a swirling air current. The ground material is entrained in the swirling air current and conveyed over the top of shroud 66 thereby presented to classifier 32's periphery, whereon the coarse particles are selectively rejected by the classifier's centrifugal action and the smaller particles are directed through classifier 32 by the radial-air current to particle-removal conduit 28. The extension of particle-removal conduit 28 into classifier 32 provides a mechanism to continuously adjust the fineness of the ground product without stopping mill operation to restructure the pulverizer/classifier assembly, changing the air flow rate, or changing the drive shaft rpm.

For example, when classifier 32 is in the shape of a cone, as it rotates, a tip speed differential is created between the classifier's first end 32*a* and second end 32*b*. At a constant total air flow rate, the apparent radial-air velocity through classifier cone 32 is affected by the extension of particle-removal conduit 28 into the classifier cone. The extension of particle-removal conduit 28 can be adjusted manually or otherwise prior to or during operation from the outside of the mill. The collected particle size (i.e., the size of the particles allowed to pass through the classifier) is determined by the local-tip speed and the apparent radial-air velocity through classifier cone 32, according to the extension of particle-removal conduit 28.

The classifier's smaller diameter end is characterized by lower tip speed and lower centrifugal force, whereas the classifier's larger diameter end is characterized by higher tip speed and higher centrifugal force. This creates a significant pressure differential gradient along the axial direction of the classifier. For example—without wishing to be bound by any particular theory—when the classifier is in the shape of a cone, and the first end 32*a* is the larger diameter end (i.e., the arrangement in FIG. 1), at constant total air flow, the effective classification surface is near the entrance end of particle-removal conduit 28 (i.e., the end of the conduit extending into the classifier). As the extension of particle-removal conduit 28 into classifier 32 increases, particles have to pass through a higher classifier tip speed region, potentially with a lower radial-air velocity. This provides increased propensity for extraction of fine particles. But as the particle-removal conduit 28 is extended very close to larger diameter end 32*a* (i.e., past a radial-air velocity minimum) the radial-air velocity will began to increase, consequently, extraction of coarser particles will be increasingly favored.

Thus, if coarser particles are desired, the extension of particle-removal conduit 28 can be adjusted to a lesser extension into classifier 32 In this way, the particles are presented to the classifier at the zone of lower-classification tip speed and higher radialair velocity. But if finer particles are desired, the extension of particle-removal conduit 28 can be increased such that the particle-removal conduit 28 extends further into classifier 32. As to the case in which the second end 32*b* of the cone classifier 32 is the larger diameter end, the effective classification surface is between the entrance end of particle-removal conduit 28 and first end 32*a* of classifier 32. As the extension of particle-removal conduit 28 into classifier 32 increases, the particles will be separated through a lower tip-speed region of the classifier, which region has a higher radial-air velocity, and the extracted particles get coarser. This situation is in favor of producing coarse-ground product.

In any case, the rejected coarse particles are conveyed around the bottom of shroud 66 to the pulverizing domain 40 for further pulverizing, while the fine particles are conveyed through the particle-removal conduit for collection.

Although the present invention has been described in considerable detail with reference to certain preferred embodiments, other embodiments are possible. Therefore, the spirit and scope of the appended claims should not be limited to the description of the preferred embodiments contained herein.

What is claimed is:

1. A mill for pulverizing and classifying particulate material, comprising:

a housing having an air intake, a particulate-material inlet, and a particle outlet;

a particulate material pulverizing and classifying assembly for receiving the particulate material from the inlet, pulverizing the particulate material into pulverized particles, and separating the pulverized particles by a size of the pulverized particles, the assembly being rotatably mounted on a drive shaft and positioned within the housing, wherein the assembly comprises a pulverizing disk rotatably driven by the drive shaft, and a classifier rotatably driven by the drive shaft and having first and second ends with the second end adjacent to the housing and the first end adjacent to the pulverizing disk such that a pulverizing domain exists between the pulverizing disk and the housing; and a particle-removal conduit connected to the particle outlet and extending into the second end of the classifier for removal of the pulverized particles and for separating the pulverized particles according to size.

2. The mill of claim 1, wherein the housing is provided with an inner liner having a selectively shaped pattern to assist in pulverizing the particulate material.

3. The mill of claim 1, wherein the pulverizing disk is drivably connected to the drive shaft, and the classifier is drivably connected to the pulverizing disk.

4. The mill of claim 1, wherein an extension of the particle-removal conduit is adjustable to control the size of the pulverized particles accepted by the classifier and directed to the particle outlet for collection.

5. The mill of claim 4, wherein the second end of the classifier fits at least partially within a groove in the housing to prevent the pulverized particles from passing around the second end of the classifier.

6. The mill of claim 4, further comprising a shroud oriented parallel to the drive shaft and surrounding at least a portion of the assembly to separate the pulverizing domain from a classifying zone of the classifier and to assist in directing the pulverized particles to the classifier.

7. The mill of claim 4, wherein the pulverizing disk supports a plurality of beaters having outer edges that are oriented parallel to the drive shaft to pulverize the particulate material.

8. The mill of claim 4, wherein the classifier comprises a plurality of angularly disposed and selectively spaced vane members.

9. The mill of claim 4, wherein the first end has a diameter that is different than that of the second end to create a tangential air velocity differential between the first end and the second end to assist in separation of the pulverized particles.

10. The mill of claim 9, wherein the classifier has a shape of a cone.

11. The mill of claim 10, wherein the diameter of the first end is larger than the diameter of the second end to provide a higher tangential air velocity at the first end for fine ground product.

12. The mill of claim 10, wherein the diameter of the first end is larger than the diameter of the second end to provide a higher tangential air velocity at the first end for coarse ground product.

13. The mill of claim 1, wherein the drive shaft comprises a single drive shaft.

14. The apparatus of claim 1, wherein the classifier has an adjustable geometry for altering the size of the particles of the fines portion extracted.

15. The apparatus of claim 14, wherein the classifier comprises a classifier rotor having an interior and the apparatus further includes a fines removal conduit in fluid communication with the rotor interior for extraction of the fines fraction from the housing.

16. The apparatus of claim 15, wherein the classifier rotor comprises a first end of a first diameter and a second end of a second diameter that the smaller than the first diameter, wherein the fines removal conduit is movable with respect to the rotor to control the size of the pulverized particles to be extracted.

17. The apparatus of claim 15, wherein the fines removal conduit extends into the second end of the classifier rotor and is movable substantially axially with respect to the classifier rotor.

18. The apparatus of claim 15, wherein the classifying rotor is tapered substantially from the first end to the second end.

19. The apparatus of claim 15, wherein the classifying rotor is attached to the pulverizing rotor for rotation therewith.

* * * * *

UNITED STATES PATENT AND TRADEMARK OFFICE

CERTIFICATE OF CORRECTION

PATENT NO. : 6,375,103 B1
DATED : April 23, 2002
INVENTOR(S) : Huang et al.

It is certified that error appears in the above-identified patent and that said Letters Patent is hereby corrected as shown below:

Title page,
Item [56], References Cited, U.S. PATENT DOCUMENTS, insert
-- 3,285,523 11/1966 Duyckinck et al. 241/53 --.

Column 6,
Lines 25-26, delete “for fine ground product”.
Line 28, change “larger” to -- smaller --.
Line 29, change “first end” to -- second end --.
Lines 29-30, delete “for coarse ground product”.

Signed and Sealed this

Twenty-second Day of June, 2004

JON W. DUDAS
*Acting Director of the United States Patent and Trademark Office*